United States Patent [19]

Santilli

[11] Patent Number: 4,940,862

[45] Date of Patent: Jul. 10, 1990

[54] VACUUM INTERRUPTER WITH IMPROVED VAPOR SHIELD FOR GAS ADSORPTION

[75] Inventor: Vincent J. Santilli, Corning, N.Y.

[73] Assignee: Westinghouse Electric Corp., Pittsburgh, Pa.

[21] Appl. No.: 426,826

[22] Filed: Oct. 26, 1989

[51] Int. Cl.[5] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,975,256 | 3/1961 | Lee et al. | 200/144 B |
| 3,090,852 | 5/1963 | Greenwood | 200/144 B |
| 3,592,987 | 7/1971 | Lempert et al. | 200/144 B |
| 3,683,138 | 8/1972 | Nabae et al. | 200/144 B |
| 3,851,203 | 11/1974 | Harris | 200/144 B |
| 4,020,304 | 4/1977 | Cherry | 200/144 B |
| 4,216,360 | 8/1980 | Cherry et al. | 200/144 B |
| 4,553,007 | 11/1985 | Wayland | 200/144 B |
| 4,574,169 | 3/1986 | Santilli | 200/144 B |
| 4,743,718 | 5/1988 | Santilli | 200/144 B |
| 4,797,522 | 1/1989 | Voshall | 200/144 B |

FOREIGN PATENT DOCUMENTS 693827 9/1964 Canada .

*Primary Examiner*—Robert S. Macon

*Attorney, Agent, or Firm*—G. H. Telfer

[57] ABSTRACT

A vacuum circuit interrupter includes a vapor condensing shield formed of a porous structure of copper including a grain size inhibitor, such as boron, and a gettering metal, such as titanium or zirconium, in order to achieve enhanced levels of gas adsorption capability.

11 Claims, 2 Drawing Sheets

VACUUM INTERRUPTER WITH IMPROVED VAPOR SHIELD FOR GAS ADSORPTION

BACKGROUND AND SUMMARY OF THE INVENTION

Figure 1:
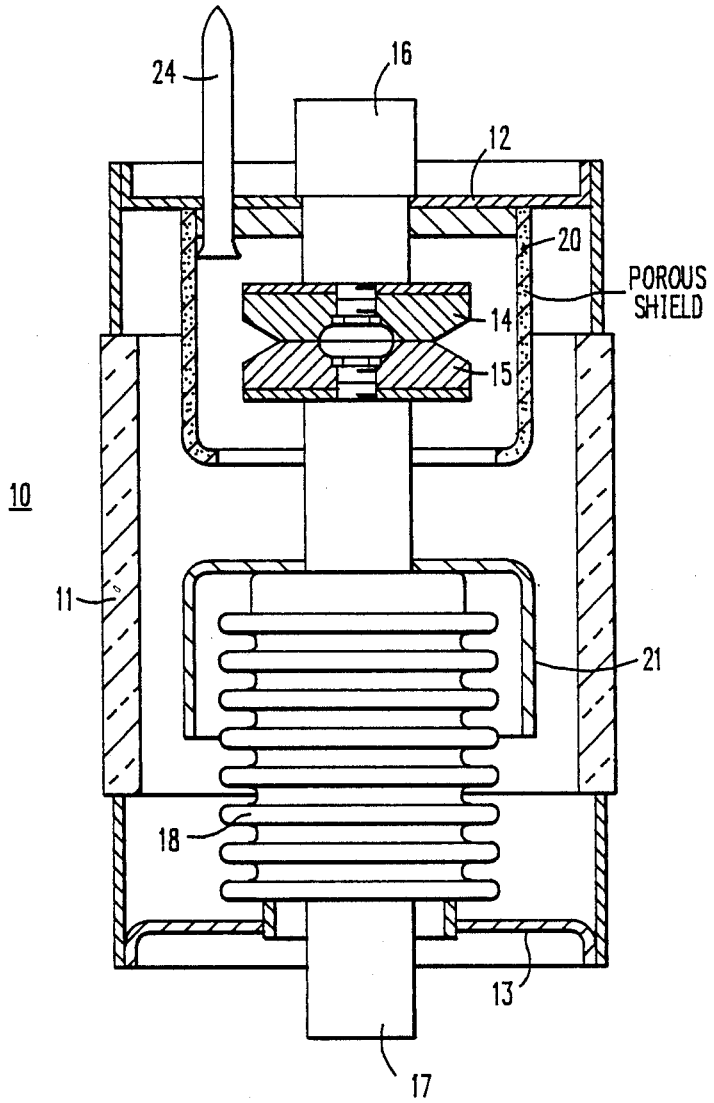

This invention relates to vacuum circuit interrupters and particularly to such devices having vapor shields.

Shields are commonly used in vacuum interrupters to condense vapors produced by arcing between the contacts. Examples may be found in Cherry U.S. Pat. No. 4,020,304, Apr. 26, 1977; Wayland U.S. Pat. No. 4,553,007, Nov. 12, 1985; and Santilli U.S. Pat. No. 4,574,169, Mar. 4, 1986, which disclose various structures and compositions for such shields.

Canadian Pat. No. 693,827, Sept. 8, 1964, is directed to a vacuum interrupter wherein at least the arc supporting region of at least one of the contacts of the device has distributed throughout its substance a metal chosen from the group consisting of titanium, thorium and zirconium; such metals being referred to as high affinity metals in providing gettering of gases generated by the operation of the device. The Canadian patent also mentions that in addition to the contacts, any surfaces in the switch which are likely to have arcs formed to them, such as a shield, can also incorporate a reactive metal to provide gas fixation.

Lempert et al. U.S. Pat. No. 3,592,987, July 13, 1971, relates to gettering action in vacuum circuit interrupters by utilizing an active gettering material, such as titanium, tantalum, colombian, zirconium, tungsten or molybdenum incorporated in the electrode structures or other interior elements of the device where such materials are incorporated as filaments, or rods, either disposed randomly or in parallel alignment in a matrix of good conducting material.

Shields in present vacuum interrupters are, at least in the part vapor impinges upon, typically of copper or copper-chromium alloys formed from particles of electrolytically produced metal that are subjected to powder metallurgy techniques. The particle size and processing achieve shields with high density, at least 90% or more, and low porosity, as has been generally preferred for good conductivity and long life.

The present invention is directed to vacuum interrupters having improved vapor shields so as to have enhanced gas adsorption capability. While gettering materials may be and preferably are used in the composition of the shield, a further improvement as compared to known shields is to construct the shield with a high porosity with intercommunicating voids to the surface. This gives the shield a tremendous absorption capability for any impinging hot vapors.

In particular, copper may be the principal constituent of the shield and may be provided with high porosity by powdered metallurgical techniques to a porosity of at least about 10%. The starting material may be electrolytic copper in particles of relatively small size, e.g., less than 10 microns or about 5 to about 10 microns. Furthermore, an additive of boron can be provided to limit the growth of the copper grains during sintering. The amount of the boron may be, for example in the range of from about 3% to about 5% by weight of the finished composition.

It is beneficial to have as an additive to the composition a quantity of titanium to getter hydrogen. Other metals such as zirconium may be used in addition or alternatively for this purpose. An additional gettering metal or metals may be, for example, in the range of from about 3% to about 5% by weight of the finished composition.

THE DRAWING

Figure 2:
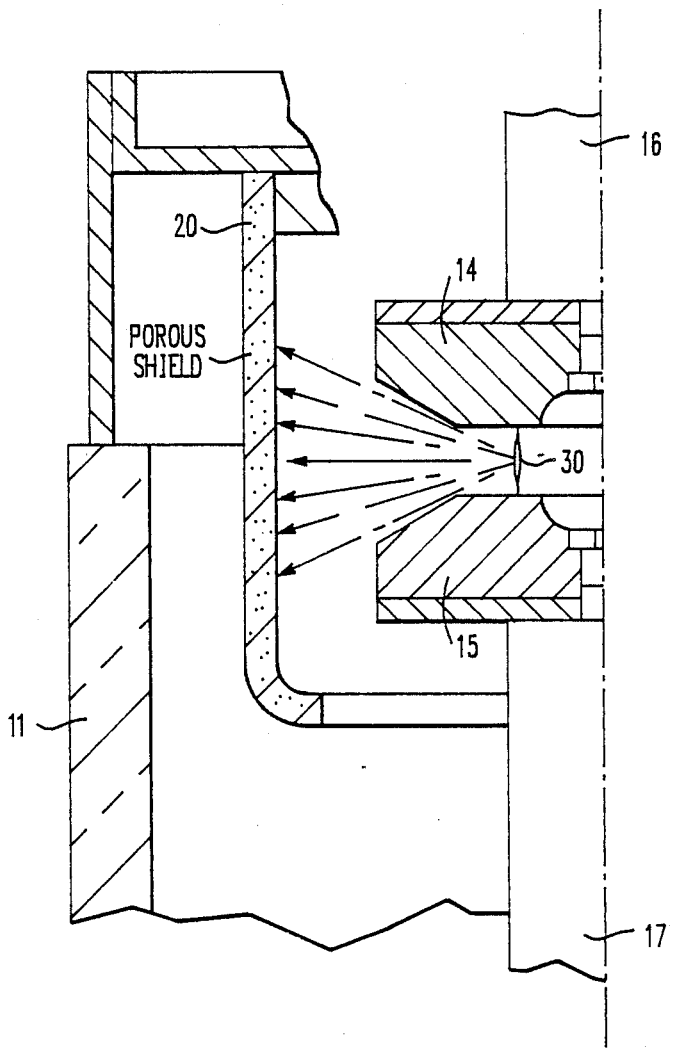

FIG. 1 is a vertical, sectional view of a vacuum interrupter, substantially in accordance with an example of the prior art, but modified to include an improved vapor shield in accordance with an embodiment of the present invention; and FIG. 2 is a partial, perspective view of a vacuum interrupter such as that of FIG. 1 illustrating principles of the present invention.

PREFERRED EMBODIMENTS

FIG. 1 shows an evacuated envelope 10 comprising a casing 11 of a suitable insulating material and a pair of metallic end caps 12 and 13 closing off the ends of the casing. Appropriate seals are provided between each of the end caps and the casing. The normal pressure within the envelope is less than about $10^{-4}$ Torr. Within the envelope 10 is a pair of relatively movable contacts or electrodes 14 and 15. When the contacts are separated, there is an arcing gap located between them. Here the upper contact 14 is stationary and suitably secured to a conductive rod or stem 16 which extends through the upper plate 12 and the lower contact 15 is a movable contact joined to a conductive operating rod or stem 17 which extends through the lower plate 13. The operating rod 17 for the lower contact 15 projects through an opening in the end cap 13 and a flexible metallic bellows 18 provides a seal about the rod to allow for movement of the rod without impairing the vacuum inside the envelope. Exhaust gas tubulation 24 is provided for establishing a vacuum within the envelope 10.

In FIG. 1, contacts 14 and 15 are shown in the closed position. When an arc develops upon contact opening some of the contact material vaporizes and these vapors are dispersed from the arcing gap toward the envelope casing 10. So as to avoid the build up of metallic material on the casing, a vapor shield 20 is provided between the arcing region and the insulating casing 10. Sometimes such shields are referred to as LR or low radiation shields. In this embodiment, a shield 21 also extends over the top part of bellows 18.

Shield 20 is joined to top end closure 12 and hence is conductively coupled with the top electrode rod 16. Shield 21 is joined with the lower electrode rod 17.

FIG. 2 illustrates the generation of an arc 30 between the contacts 14 and 15 and the impingement of material 32 produced by the arc onto the shield 20.

One of the qualities that the vapor shield 20 provides is that its presence affords additional surface for gas-solid diffusion and/or solid-gas chemical reaction to limit gas current within the device in a favorable manner. To enhance that capability for limiting gas current, in accordance with the present invention, the shield is constructed of a porous material such as having at least about 10% voids that extend from the surface substantially continuously throughout the interior. (The voids are not illustrated in the drawing.) In addition, the shield may include a certain amount of gettering material. The gettering materials themselves in additional constituents is provided to limit grain growth of the copper during sintering.

Grain growth inhibition and high porosity serve to maximize the surface area capable of gettering large amounts of gas.

The shield 20 should be fabricated from small particles of, for example, electrolytic copper for the sake of less inherent gas than is the case with larger particles. Pressing and sintering is performed to the decided degree of porosity. A suitable gettering material to include within the copper is titanium; zirconium is an alternative possibility as well as other known gettering elements. A grain size inhibitor is provided for which the metal boron is suitable.

Small amounts of the gettering material and the boron or other grain size inhibitor are effective. It is suitable to employ such metals in amounts of from about 3% to about 5% by weight of the total composition; however, benefit can also be obtained with smaller amounts of such constituents.

The porosity of the sintered material is, for example, about 10 to 20%; in other words, that is the approximate amount of voids in the structure. Another way of saying that is that the sintered density is from about 80 to about 90%. Such porosity provides long paths so that impinging hot vapors will have a channel to diffuse further into the shield and a large quantity of such gas may be adsorbed throughout the life of the device.

The improved structure and composition for the main arcing shield 20, as described above, is also advantageously used for bellows shield 21 although the latter could alternatively be of conventional construction.

In the practice of the present invention, shield 20 may either be electrically floating or electrically connected to one of the electrodes.

It will be recognized that certain variations and alternatives may be provided in accordance with the general teachings of the present invention.

I claim:

1. A vacuum circuit interrupter including in combination:

an evacuated envelope;

a pair of separable contacts disposed within the evacuated envelope and separable to establish arcing;

a vapor condensing shield provided interiorly within said evacuated envelope to prevent the deposition of metallic particles emitted from the arcing region onto the envelope;

said vapor condensing shield consisting essentially of highly conductive metal in a structure having a porosity of at least about 10%.

2. A vacuum circuit interrupter in accordance with claim 1 wherein the said metal is substantially copper.

3. A vacuum type circuit interrupter in accordance with claim wherein said shield includes a quantity of a grain size inhibitor for said metal.

4. A vacuum circuit interrupter in accordance with claim 1 wherein the composition includes a quantity of a gettering metal.

5. A vacuum circuit interrupter in accordance with claim 2 wherein:

said shield includes a quantity of boron for limiting copper grain growth.

6. A vacuum circuit interrupter in accordance with claim 5 wherein:

said boron is present in an amount of from about 3% to 5% by weight and said shield further comprises a gettering metal selected from titanium, zirconium and mixtures thereof in an amount of from about 3% to about 5% by weight.

7. A method of making a shield for a vacuum interrupter so it has a high degree of gas adsorption capability comprising:

starting with particles of high conductivity metal of a size no larger than about 10 microns;

pressing and sintering said particle to achieve a porosity of at least about 10%.

8. A method in accordance with claim 7 wherein:

said metal includes a substantial quantity of electrolytic copper.

9. A method in accordance with claim 8 wherein:

said metal includes a quantity of boron to limit grain growth of said copper.

10. A method in accordance with claim 9 wherein:

said metal includes a quantity of a gettering metal.

11. A method in accordance with claim 10 wherein:

said gettering metal is selected from the group of titanium, zirconium and mixtures thereof in an amount of from about 3–5 weight % and said boron is in an amount of from about 3–5 weight %.

* * * * *